US006862034B2

(12) United States Patent
Ernst et al.

(10) Patent No.: US 6,862,034 B2
(45) Date of Patent: Mar. 1, 2005

(54) IMAGING METHOD FOR PRINTING FORMS

(75) Inventors: Uwe Ernst, Mannheim (DE); Bernd Vosseler, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 105 days.

(21) Appl. No.: 10/383,030

(22) Filed: Mar. 6, 2003

(65) Prior Publication Data

US 2003/0169328 A1 Sep. 11, 2003

(30) Foreign Application Priority Data

Mar. 8, 2002 (DE) ..... 102 10 308

(51) Int. Cl.[7] ..... B41J 2/45
(52) U.S. Cl. ..... 347/233
(58) Field of Search ..... 347/225, 233, 347/234, 236, 238, 246, 248

(56) References Cited

U.S. PATENT DOCUMENTS 5,252,513 A * 10/1993 Paoli et al. ..... 438/24
5,305,022 A * 4/1994 Ota et al. ..... 347/233
5,521,748 A * 5/1996 Sarraf ..... 359/321
5,691,759 A * 11/1997 Hanson ..... 347/233
5,930,280 A * 7/1999 Rossi et al. ..... 372/50
6,181,362 B1 1/2001 Laberge ..... 347/233
6,252,622 B1 6/2001 Laberge ..... 347/238
2002/0005890 A1 * 1/2002 Beier et al. ..... 347/238

FOREIGN PATENT DOCUMENTS

DE 10031915 1/2002
JP 11048528 2/1999

* cited by examiner

*Primary Examiner*—Huan Tran

(57) ABSTRACT

An imaging method for a printing form (32) is described, with one or more laser diode bars (10) with n individually controllable laser diodes (12) each of which are assigned to one imaging channel, in which the laser diodes (12) of a laser diode bar (10) are divided into a main field (14) of m and into an auxiliary field (16) of (n-m) laser diodes (12) in such a way that an imaging channel (44) in the auxiliary field (16) with a matching feed that can be activated is assigned to each imaging channel (44) in the main field (14) that cannot be activated. In order to create a row (40) of m printing dots (38) on a setting line (36) at even distances a by means of the imaging channels (44), printing dots (38) are set by the main field (14) at a first time, and by the auxiliary field (16) at least at a second time. The imaging channels (44) are shifted relative to the printing form (32) parallel to the setting line (36) between the imaging times. Also, a method for the determination of the largest possible main field (14) with imaging channels (44) that under the circumstances cannot be activated is provided.

15 Claims, 4 Drawing Sheets

IMAGING METHOD FOR PRINTING FORMS

Priority to German Patent Application No. 102 10 308.9, filed Mar. 8, 2002 and hereby incorporated by reference herein, is claimed.

BACKGROUND INFORMATION

The invention relates to a method for imaging a printing form with an imaging device which includes a laser diode bar having a number n of individually controllable laser diodes, each of which are assigned to an imaging channel, whereby the imaging spots of the imaging channels are arranged essentially in a row on the printing form. Furthermore, the invention relates to a method for imaging a printing form with a number b of imaging devices each of which includes a laser diode bar, each of which has a number n of individually controllable laser diodes, whereby each laser diode is assigned to an imaging channel, and the imaging spots of the imaging channels of the number b of laser diode bars are arranged essentially in a row on the printing form.

Several imaging channels, especially those equipped with laser diodes, are often used at parallel time intervals in printing form exposure units, or printing units of printing machines containing imaging devices (so-called Direct Imaging Printing Units) in order to efficiently reduce the imaging time for the exposure of the two-dimensional surface of the printing form. If an redundant-free imaging method is used, i.e., if the imaging channels are shifted across the two-dimensional surface of the printing form in such a way that the location of each printing dot to be placed by an imaging channel is passed exactly once, the imaging time for the entire surface to be imaged with an imaging device with n imaging channels is reduced to (1/n) of the time. An additional reduction of time can also be efficiently achieved with the parallel use of b imaging units each of which exposes sections of the printing form in a redundant-free manner analogously to the procedure described above. In this case, the imaging time for the entire surface to be imaged is reduced to (1/b) of the time, more exactly, with the use of b imaging devices with n imaging channels, to (1/(bn)) of the time.

The substantial reduction of imaging time by means of redundant-free parallelization thus strongly depends on the number of the available (capable of being activated) or used imaging channels.

In order to pass, in a redundant free manner, the locations of a two-dimensional surface of a printing form on which printing dots are to be set with a number of imaging channels (regardless whether arranged on one or more imaging devices), certain feed rules are to be observed for the passing of locations to be imaged in a time pre-arranged step to locations to be imaged in a step next in time. These feed rules particularly are to be strictly met if an imaging step using n imaging channels sets n printing dots in locations that are not densely positioned on the printing form, i.e., the distance between them is not the minimum printing dot distance p (typically 10 micrometers). In order to achieve dense imaging, printing dots are set between already imaged printing dots in an imaging step next in time. This procedure also is known by as the term interleave-process (interleaving). For example, German Patent Application No. DE 100 31 915 A1 characterizes an interleave procedure for the exposure of printing forms: at a given minimum printing dot distance p and for a number of n imaging channels on a setting line at even distances to one another, the neighboring printing dots of which have a distance a on the printing form, which is a multiple of the minimum printing dot distance p, a redundant-free feed is ensured for the distance (np) in the direction of the setting line if the natural numbers n and (a/p) are prime.

In this regard, it should be explained that the two-dimensional surface of the printing form to be imaged is typically passed over rapidly by the imaging channels in a first direction, and slowly in a second direction, which is linearly independently of, preferably perpendicular, to the first direction. In this case, the setting line will not be positioned parallel to the rapid first direction, but can be tilted toward the slow second direction at an angle that is not zero. A low printing dot distance can be achieved by this tilt by the cosine factor of the angle (projection). Preferably, the setting line will be positioned perpendicularly in the rapid first direction. The printing dots of the imaging channels can also be set on the setting line using tripping times delayed relative to one another, between which the relative movement is continued between the imaging device and the printing form. Delayed tripping times are helpful, for example, for correcting geometrical errors of the imaging device structure.

The performance of a redundant-free interleave process according to document DE 100 31 915 A1 is critically dependent on the fact that n imaging channels are also available, i.e. can be activated, at even distances on a setting line. As the strategy to be followed in case of failure or malfunction of an imaging channel this document recommends using the largest remaining contiguous section of the imaging channels at even distances, if non-imaged strips on the printing form are to be avoided, and an equally good imaging quality is to be ensured. It is obvious that in order to realize a redundant-free interleave process according to the document, a number of the imaging channels of the remaining contiguous section must be selected that is prime with respect to the distance multiple (a/p). In following this strategy, any failures or malfunction of further imaging channels results in very short sections of the originally n parallel imaging channels. As a consequence, the imaging time substantially increases with the decrease of the still available parallelization. For example, in the unfavorable case of a failure of one imaging channel each in the center of the largest contiguous section on the setting line, the imaging time each increases to twice as long, i.e., a multiple of the originally parallelized imaging time in the case of several failures. This is completely unacceptable in practice.

The failure or malfunction of a laser diode is generally especially critical with the use of laser diode bars in imaging devices if exactly one laser diode is assigned to each imaging channel, because in order to reestablish the original functionality replacement of the entire laser diode bar is necessary. For economical reasons alone this is not feasible, because the other laser diodes on the bar are generally still functional, and the laser diode bar as a whole has not completely malfunctioned.

U.S. Pat. No. 6,181,362 B1 recommends assigning two laser diodes for each imaging channel on the laser diode bar. For imaging a printing form, one laser diode each is used per imaging channel. In the case of failure of the first laser diode in an imaging channel, the second laser diode is used in its place. However, the document leaves open how to proceed if the redundant laser diodes of an imaging channel fail at the same time.

As an alternative, U.S. Pat. No. 6,252,622 B1 recommends assigning a first laser diode on a first laser diode bar, and a second laser diode on a second laser diode bar for each imaging channel. For imaging a printing form, one laser diode of one of the two laser diode bars is used per imaging channel. In case of a failure of the first laser diode on the first laser diode bar in an imaging channel, the second laser diode on the second laser diode bar is used in its place. However, the document leaves open how to proceed if the redundant laser diode of an imaging channel fails at the same time.

The solutions of both documents U.S. Pat. No. 6,181,362 B1, and U.S. Pat. No. 6,252,622 B1 have in common that, roughly speaking, a replacement diode is provided for each imaging channel in the case of a malfunction. As a consequence, this method is cost intensive. From the start, twice the number of laser diodes is required in order to ensure a safe strategy. A priori, a multitude of replacement diodes are generally not necessary in practice. Both documents fail to offer any principal solution for the problem of how to proceed in case one or several imaging channels fail.

BRIEF SUMMARY OF THE INVENTION

An object of the invention at hand therefore, is to provide a rapid imaging of a printing form with the use of an imaging device that is comprised of a laser diode bar containing n laser diodes, of which some of the laser diodes have failed.

The invention provides a method for imaging a printing form (32) with an imaging device (54) comprised of a laser diode bar (10), which has a number n of individually controllable laser diodes (12) that are assigned to one imaging channel (44) each, whereby the imaging spots of the imaging channels (44) are positioned on the printing form (32) essentially in a row, and are shifted relative to the printing form (32) at least with one shifting component parallel to a setting line (34). The method is characterized by the following steps: dividing the number n of laser diodes into a main field (14) with a number m of laser diodes (12) and into an auxiliary field (16) with a number q of laser diodes (12), whereby n>m and q=(n−m); imaging the printing form (32) with a number (m−r) of laser diodes (12) from the main field (14) at a time $t_m$, whereby the imaging spots are positioned essentially on the setting line (34) of the printing form (32), and r $\epsilon$(1, . . . q); and imaging the printing form (32) with the number r of laser diodes (12) from the auxiliary field (16) at least at a different time $t_a$ that is different from the time $t_m$, whereby the imaging spots are positioned essentially on the same setting line (34) in such a way that the printing dots (38) created by the main field (14) at the time $t_m$, and the printing dots created by the auxiliary field (16) are positioned in a row (40) of m printing dots (38) at even distances a.

The invention utilizes the knowledge, among others, that with malfunction of some of the laser diodes on a laser diode bar and when only a section of laser diodes of the laser diode bar still can be used for imaging, some functioning laser diodes possibly still exist in a complementary section (contiguous or not contiguous) of the laser diode bar. In other words, the invention utilizes the still functioning laser diodes outside of the section used for imaging in the place of laser diodes within the section. Therefore, the section and the complementary section together form the laser diode bar. This procedure is particularly advantageous if a laser diode cannot be activated within the section, i.e., if its assigned imaging channel malfunctions, or if the section has been selected so large that it contains failed laser diodes. The knowledge is therefore comprised of the fact that due to the selection of a section, a complementary section is defined in such a way that imaging channels can be utilized redundantly from the complementary section. As a result, the section is called the main field, and the complementary section is called the auxiliary field.

The invention includes an imaging method for a printing form with one or several laser diode bars with n individually controllable laser diodes, each of which are assigned to one imaging channel, in which the laser diodes of a laser diode bar are divided into a main field of m and into an auxiliary field of (n−m) laser diodes. The division occurs in such a way that each imaging channel that cannot be activated in the main field is assigned an imaging channel in the auxiliary field that can be activated, with a matching feed. In other words, m laser diodes are activated from n laser diodes for the imaging of the printing form; a selection of m laser diodes must be made from the n laser diodes. An advantageous feed is given particularly by the number m of the laser diodes in the main field. In other words, the inventive method utilizes the redundancy which occurs by means of the division into the main field and into the auxiliary field in an advantageous manner by means of a variable feed, adjusted, for example for failed imaging channels that cannot be activated, to provide correspondence to the originally independent imaging channels on the laser diode bar. Contrary to known methods or devices, no redundant provision of additional laser diodes is necessary for the imaging channels, because redundancies are created in the imaging channels by means of a feed change.

In order to create a number of m printing dots on the setting line of the printing form at even distances a by means of the imaging channels, printing dots are set by the main field at a first time, and by the auxiliary field at least at a second time. The imaging channels are shifted between the individual imaging times relative to the printing form with at least one shifting component parallel to the setting line. It is possible at the same time to perform an interleave procedure on the basis of m imaging channels for the creation of a series of m printing dots on the printing form at even distances a though the m imaging channels are unevenly (that is within and outside of the main field) positioned on the laser diode bar.

The invention also includes a method for determining the largest possible main field with any given imaging channels that cannot be activated for the inventive method for imaging a printing form. As described above, a short imaging time for the exposure of the surface of a printing form may be achieved particularly by means of a high parallelization, i.e., the simultaneous use of several imaging channels. In the method according to the invention, a strong shortening is achieved by means of the largest possible main field: a parallelization of m imaging channels that can be activated simultaneously, on a laser diode bar with n laser diodes leads to (1/m) of the time. In other words, a loss of parallelization only leads from (1/n) of the time of a simple exposure to (1/m) of the time of the simple exposure. However, (1/m) of the time of the simple exposure is generally shorter in the case of a failure of several laser diodes, than (1/l) of the time that is required for the exposure of the entire surface of the printing form to be imaged, if only 1 set of contiguous laser diodes are available. The utilization of the method according to the invention is therefore more advantageous than the simple strategy of utilizing only the still contiguous section of laser diodes capable of being activated. In other words, in the method according to the invention, a larger feed, or a larger number, respectively, of the parallel imaging channels is used in an advantageous manner than in the method of the simple strategy, and therefore a lower total imaging time is achieved.

According to the invention, the method for imaging a printing form with an imaging device including a laser diode bar, which has a number n of individually controllable laser diodes, each of which are assigned to an imaging channel, whereby the imaging spots of the imaging channels are positioned on the printing form essentially in a row, is comprised of at least the following steps: the number n of laser diodes is divided into a main field with a number m of laser diodes, and into an auxiliary field with a number q of laser diodes, whereby n>m, and q=(n−m). The printing form is imaged with a number (m−r) of laser diodes from the main field at a time $t_m$, whereby the imaging spots are positioned essentially on a setting line of the printing form, and r is $\epsilon(1, \ldots, q)$. Typically, r is the number of the failed imaging channels, or those that cannot be activated. The printing form is imaged with a number r of laser diodes from the auxiliary field, whereby r is $\epsilon(1, \ldots, q)$, and is the same r as for the main field, in at least another time $t_a$ that differs from the time $t_m$, whereby the printing dots are positioned essentially on the same setting line in such a way that the printing dots created by the main field at the time $t_m$, and the printing dots created by the auxiliary field are positioned in a row of m printing dots at even distances a. This means that r laser diodes capable of being activated are taken from the auxiliary field, which correspond to the r failed laser diodes in the main field. The imaging channels are shifted relative to the printing form at least by a shifting component that is parallel to the setting line.

At this time, a brief note regarding the term time is necessary. Time, in the context of this imaging, can be both an individual point of time, as well as a—preferably short, whereby short is to be considered in the context of the total imaging time—time interval. In the context of the imaging of a series of printing dots by means of laser diodes that are independent of one another in individually controllable imaging channels, it is common practice to release the individual laser diodes relative to one another at delayed time intervals, while the printing form moves relative to the imaging channels into a direction that is perpendicular to the imaging channels. This delayed release or activation results in the individual imaging spots setting a printing dot at different coordinates on the surface of the printing form than those coordinates on which the imaging spot is positioned at a time when another laser is released. A time interval is then comprised of the individual time points of the activation of the laser diodes, in order to set a series of printing dots. With certain limitations, the relative position of the printing dots can be influenced during the setting process by using time-delayed activations.

In a preferred embodiment of the method for imaging a printing form, the number m of laser diodes forms a contiguous main field. The auxiliary field can be either contiguous, or non-contiguous. However, a contiguous auxiliary field is preferred.

For the realization of a redundant-free interleave process, it is particularly advantageous in the method according to the invention, if the distance of neighboring imaging spots a is k times the minimum printing dot distance p, and k and the number m of the laser diodes in the main field are relatively prime. It is particularly advantageous and preferred, if k is a prime number ({2, 3, 5, 7, 11, 13, 17, . . . }). This provides many possible m, which are generally larger than k, relatively prime to k. It is obvious that a relative prime relationship is achieved particularly if both m as well as k are prime numbers that are different from each other.

In a first embodiment of the method, imaging spots for the creation of the even row of m printing dots are set only at a different time $t_a$ in a combined action with the imaging by the main field at the time $t_m$. The imaging channels are shifted between the time $t_m$ and the other time $t_a$, regardless whether $t_m$ is earlier than $t_a$, or if $t_a$ is earlier than $t_m$.

In a second embodiment of the method, an imaging is performed with the auxiliary field at a number j of other times $t_{ai}$, whereby i=1, . . . j in such a way that the printing dots created by the main field and the printing dots created by the auxiliary field are positioned at even distances a in a row of m printing dots. The imaging channels are shifted between each imaging step: the imaging channels are shifted between the time $t_m$, and each of the other times $t_{aj}$, regardless whether $t_m$ is earlier than $t_{ai}$, or whether $t_{ai}$ is earlier than $t_m$ with i=1. . . j.

The method for imaging a printing form according to the invention can be used as follows for a number of rows of m printing dots, especially those rows, the printing dots of which are positioned partially entwined: the imaging steps described above are reiterated, or repeated in the manner in which a number of rows of m printing dots each is created at even distances a. The time $t_m$ of the imaging of a first row of m printing dots by the main field can coincide with at least a time $t_a$ of the imaging of a second row of m printing dots by the main field. In other words, when a second part of a first row is written with the main field, the first part of which has already been written by the auxiliary field at a previous time, a first part of a second row will already be written by the auxiliary field.

In the method for imaging a printing form according to the invention, the feed in the direction of the setting line between two imaging steps for a row of m printing dots at even distances a can either be a multiple of the m times minimum printing dot distance p, or the m times minimum printing dot distance p. A feed of this size is particularly necessary for a redundant-free interleave method as described in detail above. If the distance of the imaging channels neighboring the printing dots is merely the minimum printing dot distance p, the imaging channel reaches the position of the corresponding imaging channel of the main field (the auxiliary field, respectively) from the auxiliary field (the main field, respectively) after a feed of the length (mp). If the distance a of the imaging channels neighboring the printing dots is k times the minimum printing dot distance p, whereby k is preferably a prime number, the imaging channel reaches the position of the corresponding imaging channel of the main field (the auxiliary field, respectively) from the auxiliary field (the main field, respectively after a number k of feed lengths (mp), thus after a feed across the entire length (kmp).

The method according to the invention can be performed at a particular advantage with the use of imaging devices that are assigned to a printing form received by a rotatable printing form cylinder. It is particularly favorable, if the setting line is oriented essentially parallel to the cylinder axis. The shifting of the imaging channels then occurs relative to the printing form also with an additional shifting component in a circumferential direction of the cylinder perpendicular to the setting line by means of rotating the printing form cylinder, whereby a feed is exactly achieved parallel to the setting line equal to m times the printing dot distance p in the direction of the setting line, if the cylinder has performed a complete rotation. In other words, the imaging spots of the imaging channels are directed along paths around the circumferential surface of the cylinder that are helix-shaped, and parallel to one another. The helices then appear as entwined in one another along the setting line at a certain azimuth angle of the cylinder so that, projected onto the setting line, this method can be referred to as an interleave process. It must be reiterated, however, that in reality only m, or, with the use of a number b of imaging devices only (bm), helices that are parallel to each other are written, which densely image the two-dimensional surface of the printing form to be imaged.

The method for imaging a printing form on a printing form cylinder according to the invention can advantageously be used in a printing unit, or a printing machine, especially for imaging devices in printing units where laser diode bars can be exchanged only with substantial effort. The printing machine can be a web or sheet-fed machine. The printing process used by the printing machine is preferably a direct, or indirect flat printing process, an offset printing process, or a flexographic printing process. Typical printing materials are paper, carton material, cardboard, or organic polymer materials.

As clearly obvious from the context described above, it is particularly advantageous to use a number m for the division of the n laser diodes of a laser diode bar into the main field and the auxiliary field, which number m should be as large as possible. In an advantageous further embodiment of the inventive method, a step is therefore provided, in which an advantageous number m is determined in the following manner: all imaging channels of the laser diode bar that have failed are determined. The laser diodes are counted from 1 to n, and these are referred to as the first to the nth position. The laser diode bar is divided into in a potential main field containing a number of m' laser diodes, whereby m' is the largest natural number that is prime with respect to the minimum distance of neighboring imaging spots a and smaller than n, and a potential auxiliary field containing a number q', whereby $n>m'$, and $q'=(n-m')$. In the case of a failed imaging channel at the i position of the potential main field it is checked whether a functional imaging channel exists in the potential auxiliary field at the $i\pm r*m'$ position, whereby r is a natural number. The check is repeated or reiterated for all failed imaging channels. For all imaging channels in the main field that have failed, it is determined whether imaging channels capable of being activated exist for the feed at the corresponding position in the auxiliary field or not. The division and checking of the imaging channels with a reduced, other number m' is repeated until all failed imaging channels in the potential main field correspond to functional imaging channels in the potential auxiliary field. The largest m' is then selected or determined as the number m, in which all failed imaging channels in the potential main field correspond to functional imaging channels in the potential auxiliary field.

The method for imaging a printing form according to the invention can also be used for imaging with a number b of imaging devices that each contain a laser diode bar, which each contain a number n of individually controllable laser diodes, whereby each laser diode is assigned to an imaging channel, and the imaging spots of the imaging channels of the number b of laser diode bars are each positioned essentially in a row on the printing form, by at least performing the following steps: A number $m<n$ is determined by means of the procedure stated above in such a way that functional imaging channels in the auxiliary field correspond to failed imaging channels in the main fields for each of the number b of laser diode bars. The number n of laser diodes of each of the number b of the laser diode bars is divided into a main field with the number m of laser diodes and into an auxiliary field with a number q of laser diodes, whereby $q=(n-m)$. The printing form is imaged with the number b of main fields, and the number b of auxiliary fields, and by shifting the imaging channels relative to the printing form, as described above for an imaging device with a laser diode bar.

It should also be noted that the data to be written may possibly have to be resorted in dependency of the feed used in the inventive method, and the imaging channels used in consideration of the position of the imaging channels in the main field and in the auxiliary field so that the printing dot to be written at the assigned coordinates of the printing form that corresponds to the data is written at the time when the assigned imaging channel passes the assigned coordinates.

The invention also includes an inventive imaging device for a printing form that comprises at least one laser diode bar, which has a number n of individually controllable laser diodes each of which are assigned to an imaging channel. The inventive imaging device comprises a control unit with processor device, in which a program is executed, which has at least a section in which a calculation of the division of the number n of laser diodes into a main field and into an auxiliary field in dependency of the results of the functional inspection devices of the laser diodes, for example measuring devices for the laser diodes on the diode laser bar, as well as for performing process steps for the imaging described above in detail. As an option, the control unit can be coupled to the machine controls. The control unit includes connections, also possibly via the machine controls, for the actuator means for the creation of the relative movement between the printing form and the imaging device. A resorting of data for the imaging can occur in the control unit and/or in an upstream data processing unit regardless of the division into the main field and into the auxiliary field.

The imaging device according to the invention can be used in a printing form exposure device, or in a printing unit of a printing machine with particular advantage. A printing machine according to the invention, which contains one or more inventive printing units, can be a web or sheet-fed processing machine. The printing method based on the printing unit, or the printing machine according to the invention can be a direct, or indirect flat printing process, a flexographic printing process, an offset printing process, or similar method.

BRIEF DESCRIPTION OF THE DRAWING

Additional advantages, and advantageous embodiments and further developments of the invention will be illustrated in the following figures, as well as their descriptions. They show in detail.

DETAILED DESCRIPTION

Figure 1:
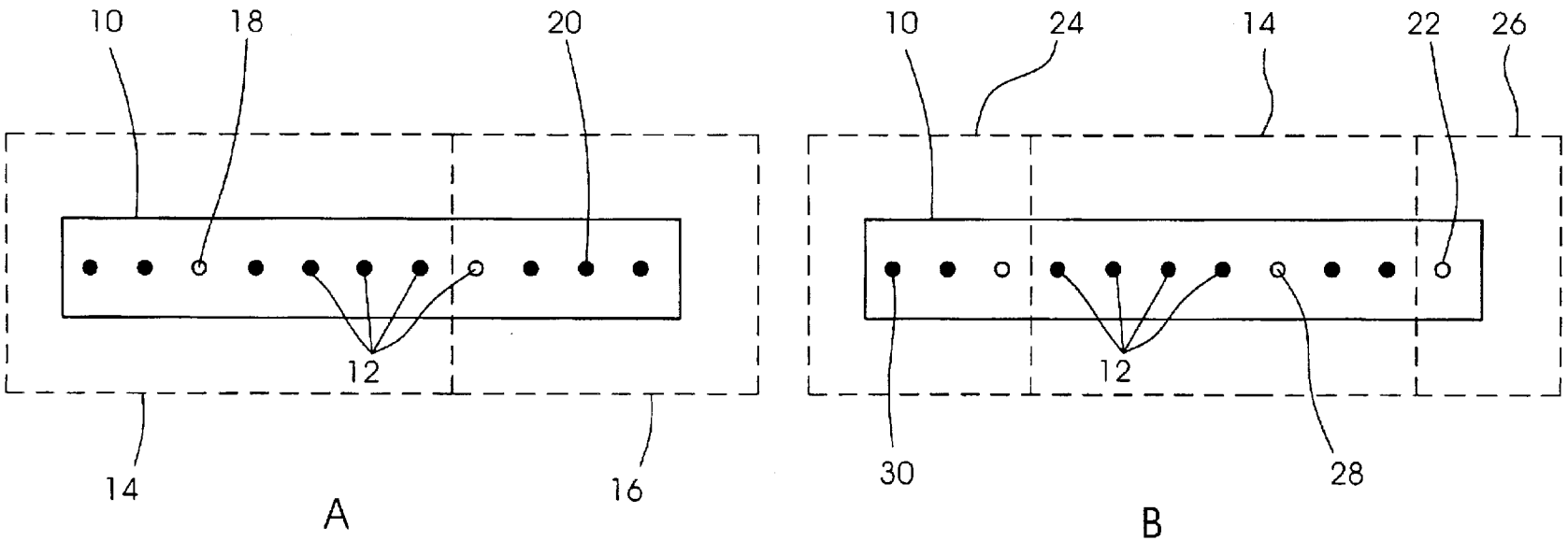
FIG. 1 Divisions of exemplary laser diode bars, on which the laser diodes are not capable of being activated, into the main field and into the auxiliary field, FIG. 2 a schematic imaging of the position of rows of printing dots on the surface of the printing form, FIG. 3 an imaging by means of the auxiliary field of the laser diode bar at a first time of a first part of a first row of printing dots, and an imaging by means of the main field of the laser diode bar at a second time of a second part of the first row of printing dots, and of a first part of a second row of printing dots, and FIG. 4 two imaging devices with laser diode bars for the imaging of a printing form in a printing unit that is received by a printing form cylinder, whereby the laser diode bars are divided into the main fields and into the auxiliary fields in order to perform an imaging corresponding to the method according to the invention.

FIG. 1 shows divisions of an exemplary laser diode bar, on which the laser diodes are not activated, into the main field and into the auxiliary field. The partial view A in FIG. 1 shows a laser diode bar 10 with eleven example laser diodes 12, which are arranged essentially in a row. It is provided that in the regular operation of the laser diode bar 10 without malfunction, each laser diode 12 is assigned to exactly one imaging channel, and the imaging spots of the seven laser diodes 12 are imaged, essentially in a row, on a setting line onto a printing form. It is indicated in this figure that the third and the eighth laser diodes, counted from the left of the figure, have failed. A division of the laser diode bar 10 can now occur in a purposeful manner into a main field 14 with seven laser diodes 12, and into an auxiliary field 16 with four laser diodes 12: In a feed of seven laser distances—corresponding to a feed of seven distances a of neighboring imaging spots, i.e., 7*(kp)—the imaging channel of the failed third laser diode 18 in the main field 14 correlates to the imaging channel of the functional tenth laser diode 20 in the auxiliary field 16.

The partial view B of FIG. 1 shows a laser diode bar 10 with eleven exemplary laser diodes 12, on which, for instance, the third, the eighth, and eleventh laser diodes, counted from the left of the figure, have failed. A division of the laser diode bar 10 can occur into a contiguous main field 14 and into a non-contiguous auxiliary field with a first part 24 and a second part 26 in such a way that seven laser diodes 12 are present in the main field 14, and four laser diodes 12 are present in the auxiliary field. In a feed of seven laser distances—corresponding to a feed of seven distances a of neighboring imaging spots, i.e., 7*(kp)—the imaging channel of the failed eighth laser diode 28 in the main field 14 correlates to the imaging channel of the functional first laser diode 30 in the first part 24 of the auxiliary field.

According to the inventive method, an imaging with a parallelization of seven imaging channels can be performed in both example cases shown; however, in failures according to the simple strategy, an imaging could be performed only with a parallelization of four, or three, imaging channels. The example given in FIG. 1 illustrates clearly, how an increase in parallelization by means of division of the laser diode bars 10 into the main field 14 and into the auxiliary field 16 can be achieved with a variable feed.

It is clear to the skilled person from the description that the division into the main field and into the auxiliary field develops its advantageous effect with the failure of at least two imaging channels (laser diodes). If only one imaging channel fails, exposure can be performed with the largest contiguous partial component of functioning and neighboring imaging channels. If an additional imaging channel then fails in this partial section (main field), it can be replaced by an imaging channel from the complementary partial section (auxiliary field), insofar as the corresponding location in the complementary partial section for the selected feed has a functional imaging channel. It is clear that if both the imaging channel in the partial section, as well as the corresponding imaging channel in the complementary partial section, are functional, either the imaging channel in the partial section, or the imaging channel in the complementary partial section can be used for writing. Furthermore, it is also clear that a corresponding location in the complementary partial section can also be achieved by a multiple of the selected feed. This can be the case, in particular, if only a small number, especially smaller than n/2, compared to the original number n of imaging channels are functional. Therefore, in other words, the auxiliary field provides corresponding functional imaging channels that reach positions of malfunctioning imaging channels of the main field by means of one feed or a multiple of feeds.

Figure 2:
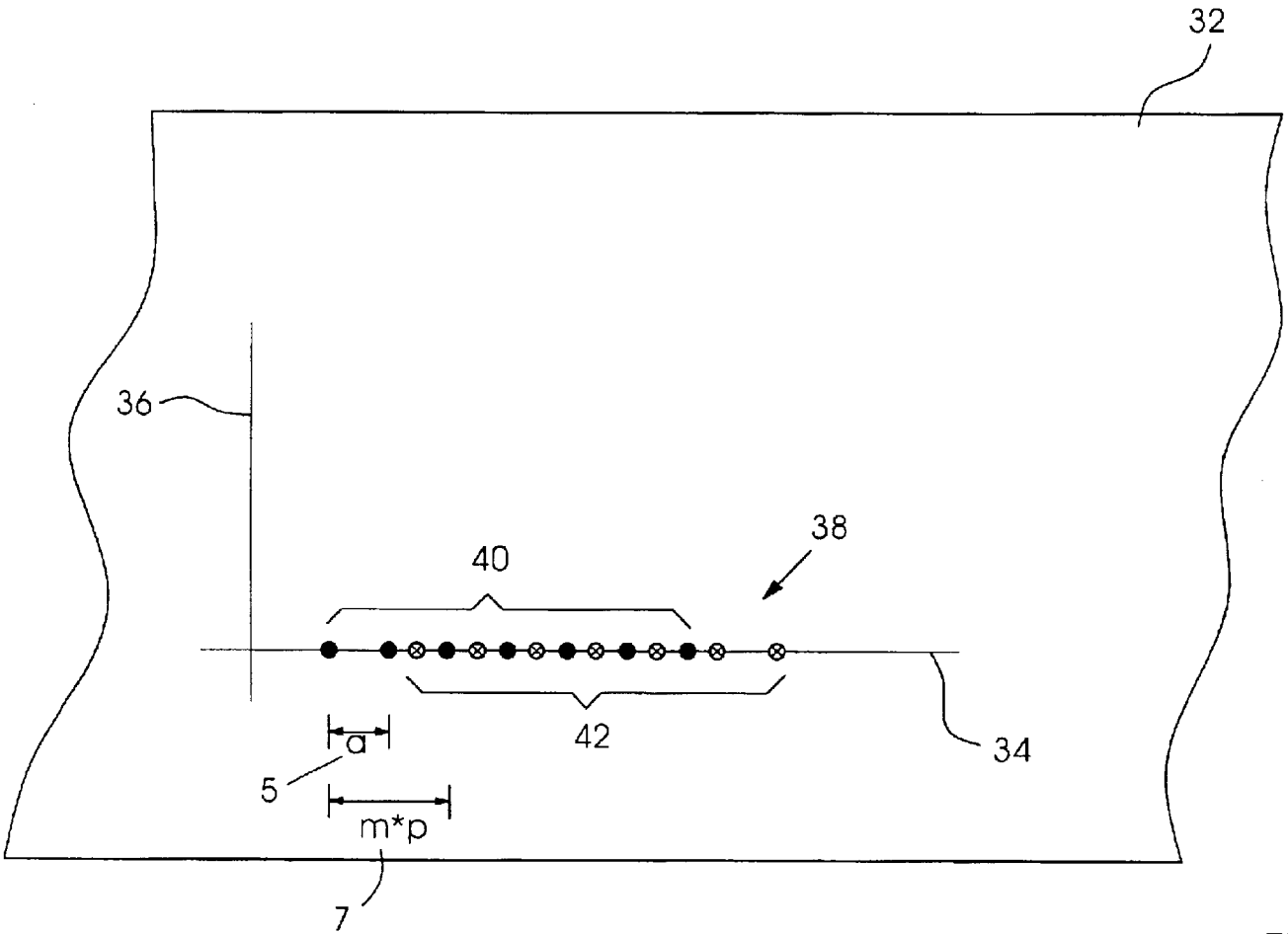

FIG. 2 is a schematic imaging of the position of rows of printing dots on the surface of the printing form. FIG. 2 schematically shows a printing form 32, the two-dimensional surface of which is set in two dimensions from a setting line 34, and a direction 36 that is perpendicular to the setting line 34. Along the direction of the setting line, the printing form is exposed in an interleave process by means of a number of imaging spots of imaging channels, here, for example, seven imaging channels. Each imaging channel writes printing dots 38. During a first imaging step, a first row 40 of m printing dots, here, for example, m=7 printing dots 38 (as filled in circles). Neighboring printing dots in the first row 40 have an equidistant distance a. In a second imaging step, after the feed of the imaging channels by a length (mp) in the direction of the setting line 34, a second row 42 of m printing dots, here also seven (illustrated as crossed circles) are imaged at an equidistant distance a.

Along the setting line 34, an interleave process is used in this context, as the printing dots of the second row 42 are at least partially set between printing dots (second imaging step timed downstream) of the first row 40 (first imaging step timed downstream). In practice, this interspersing is achieved in the following manner by means of a crossing of the path of the imaging channels across the two-dimensional printing form: typically, the two-dimensional printing form in one of the two linear independent directions in the three-dimensional space is bent in such a way that lengths are located in this direction on a closed path. For example, the two-dimensional printing form is received by a rotating body, especially a cylinder. If the imaging channels are then shifted relative to the printing form, the paths of the imaging channels will periodically cross a length in a perpendicular direction to the direction of the closed path. This is the case especially if the imaging channels describe a helix-shaped path across the printing form 32 received by a cylinder, whereby the direction 36 is the circumferential direction. At a respective stroke (feed), the helix-shaped paths then cross the setting line 34 in the direction of the cylinder axis at points on which printing dots 38 can be set in a second imaging step that is timed downstream in such a way that they come to rest between printing dots 38 of a first imaging step that is timed upstream. In other words, the helices of the individual imaging channels therefore are positioned entwined with one another without crossing each other.

Figure 3:
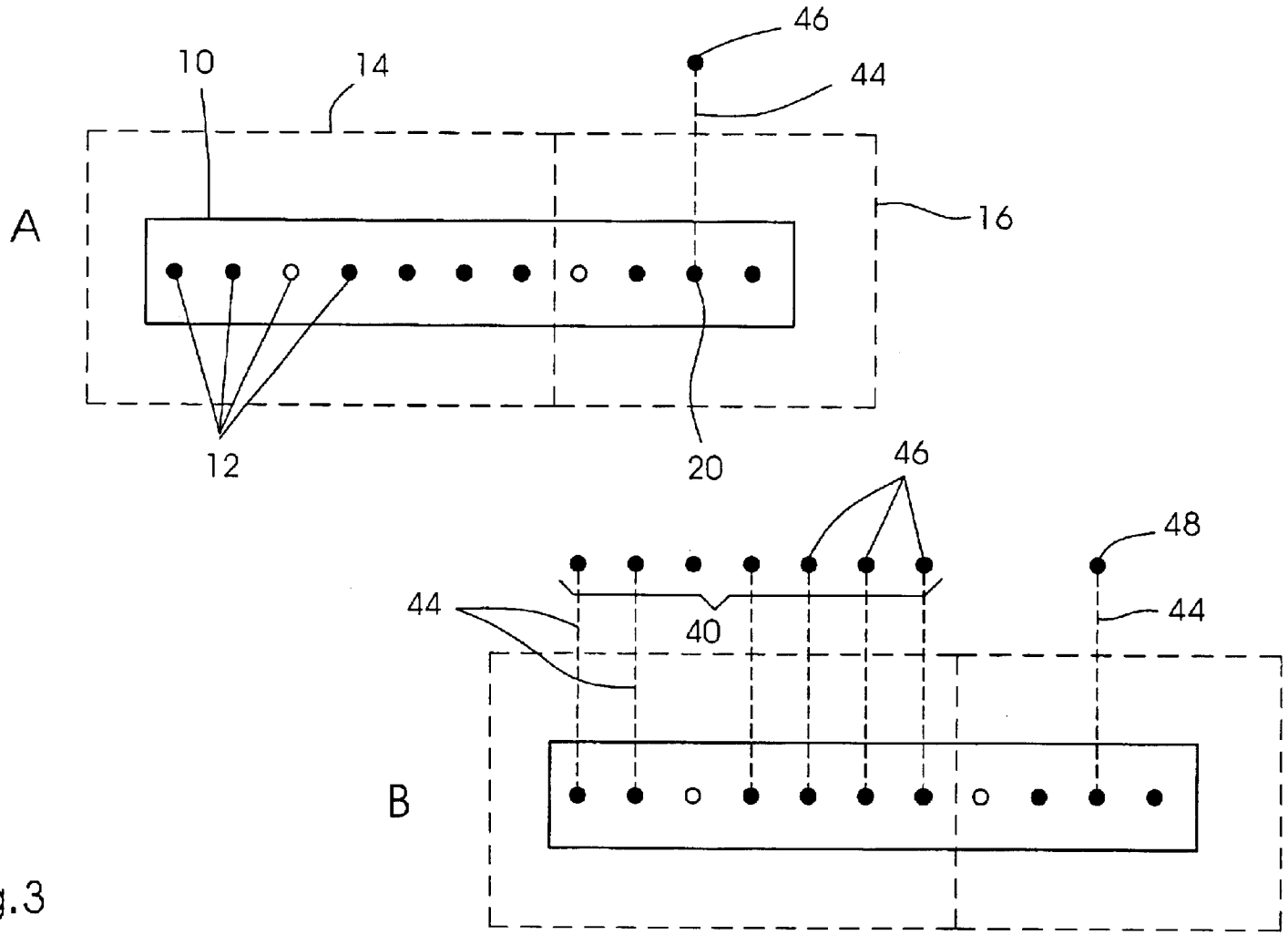

FIG. 3 schematically refers to an imaging by means of the auxiliary field of the laser diode bar at a first time of the first part of a first row of printing dots, and an imaging by means of the main field of the laser diode bar at a second time of the second part of the first row of printing dots, and a first part of a second row of printing dots.

The partial view A of FIG. 3 shows a laser diode bar 10 with eleven exemplary laser diodes 12, which, as illustrated in FIG. 1, are for example divided into a main field 14 with seven laser diodes 12 and into an auxiliary field 16 with four laser diodes 12. The main field in this example has six functional laser diodes 12 (drawn as filled-in circles), and one malfunctioning laser diode 12 (drawn as a simple circle), here, for example, the third laser diode, counted left from the figure. The failed third laser diode corresponds at a feed of seven distances a of neighboring printing dots, i.e., 7*(kp), with the notation explained in detail above, to the functional tenth laser diode 20. The partial view A shows a first imaging step: in order to set a first part of a first row 40 of printing dots, here a printing dot 46 of the first row 40, the functional tenth laser diode 20 is triggered, and the imaging channel 44 is activated for providing energy on the surface of the printing form.

Before the partial view B of FIG. 3 is described, it should be explained that it is assumed without limitation the general validity for distances a=(kp) of neighboring imaging spots of the inventive method, that the imaging spots of the imaging channels are closely positioned on the printing form, in other words that k=1. This choice is intended to serve merely for the simple explanation of the interaction of the first and the second imaging steps. While, as mentioned above, k may be other than 1, and k feeds of the interleave procedure (mp) are necessary until the imaging channels have achieved those positions of the point at which the additional printing dots of the first row 40 are located, it is clear that for k=1 only a feed of the width (mp) is necessary, i.e., in the detailed example in FIG. 3 of 7p. The partial view B of FIG. 3 therefore shows the situation after this said feed in a second imaging step: in order to set the second part of the first row 40 of printing dots, here the printing dots 46 of the first row 40, the six functional laser diodes 12 of the main field 14 are triggered; the imaging channels 44 are activated for providing energy on the surface of the printing form. It is possible that in the sense of the term time described in detail above, the functional tenth laser diode 12 of the auxiliary field 16 is simultaneously controlled, in order to set a printing dot 48 of a second row (drawn as a crossed circle), by applying energy on the surface of the printing form across the imaging channel 44. The partial view A and the partial view B are shifted vertical to the direction defined by the row of the laser diodes 12 for purposes of illustration only, and the printing dot 46 set by the third, or tenth imaging channel 44, respectively, is illustrated twice in the partial images.

The iteration or continuance of the action for completing the second row 42, and for additional rows of printing dots, is obvious by means of the description in FIG. 3.

Figure 4:
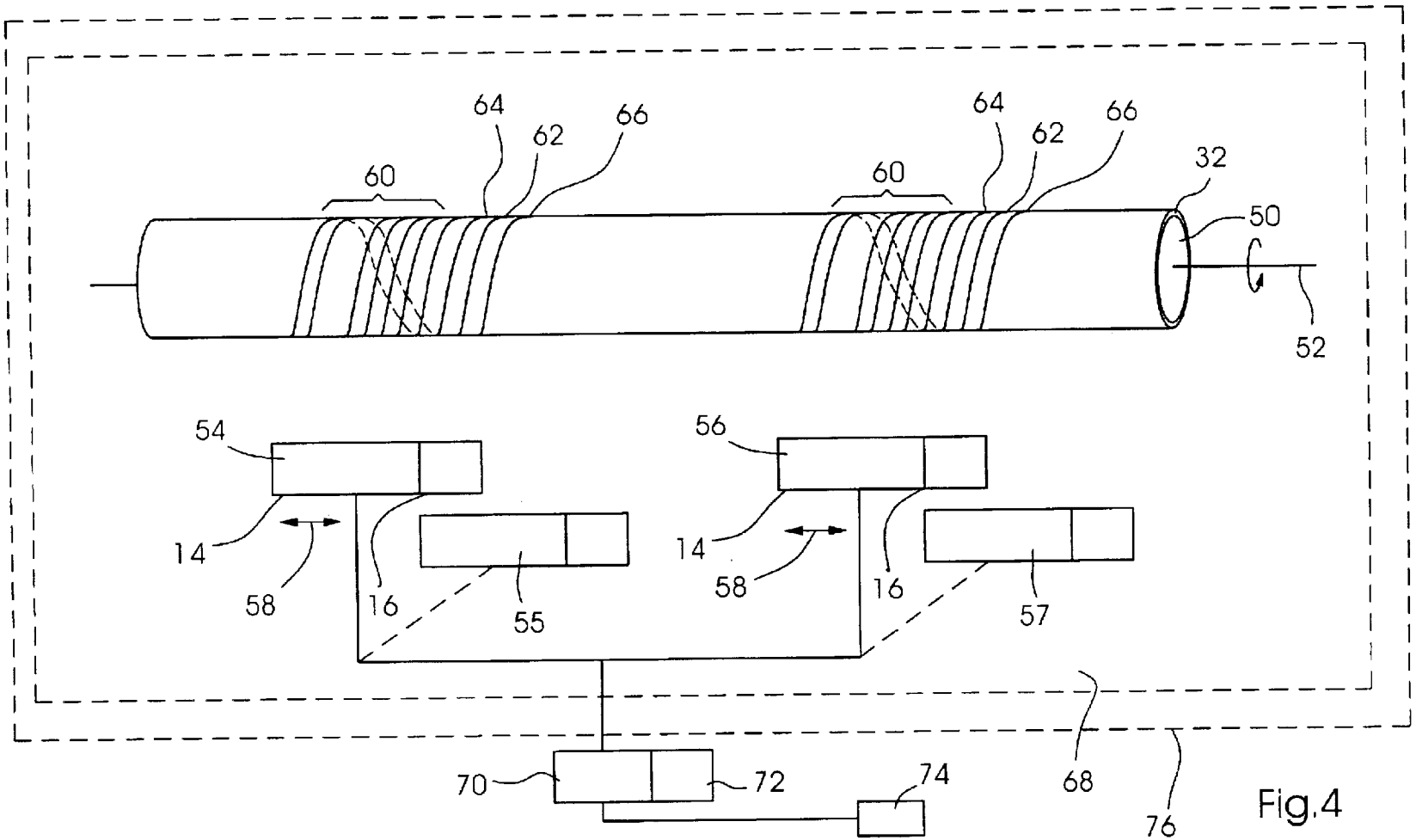

FIG. 4 shows two imaging devices with laser diode bars for imaging a printing form in a printing unit, received by a printing form cylinder, whereby the laser diode bars are divided into main fields and auxiliary fields in order to perform an imaging according to the inventive method. The printing form 32 is received by a printing form cylinder 50 that rotates around its cylinder axis 52. A first imaging device 54, and a second imaging device 56 can be moved in the translation direction 58 relative to the surface of the printing form 32 essentially parallel, and preferably parallel, to the cylinder axis 52. The first imaging device 54 and the second imaging device 56 can also be moved relative to one another, i.e., the distance between them can be changed. In this regard it is obvious that if the first and the second imaging devices 54, 56 are fixed with respect to one another, the same feed, i.e., also the same division of the number n of laser diodes on the laser diode bar into main field and into auxiliary field, must be performed. If, however, the first and the second imaging devices 54, 56 also move relative to one another, different divisions into the main field and into the auxiliary field, as well as any resulting imaging steps, may be performed independently. Nonetheless, the imaging time will be determined by the slow imaging, i.e., the imaging with the lowest parallelization of the imaging device if each imaging device is assigned approximately the same part of the surface of the printing form to be imaged.

A common imaging a printing form 32 is performed by means of the timed parallel use of the two imaging devices 54, 56, in that the first imaging device 54 exposes a first part of the entire surface to be imaged, and the second imaging device 56 exposes a second part of the entire surface to be imaged, as the complementary piece of the first part. The printing dots of the first and second parts together form the disjointed sub-amounts of the amount of the total printing dots to be set. The sub-amounts can be located on the printing form either contiguous, or non-contiguous (at least one printing dot that is not next to the other printing dots of the sub-amounts, i.e., the printing dots with only the neighboring printing dots from the complementary piece).

The imaging spots of the imaging channels of the first and second imaging devices 54, 56 pass the surface of the printing form 32 on helix-shaped paths 60 in such a way that printing dots can be placed densely, generally according to an interleave process as described above. According to the example used above, it is assumed that several imaging channels, or laser diodes, respectively have failed on the first and the second imaging devices 54, 56, and that the laser diode bars of the first and second imaging devices 54, 56 have been divided similarly into a main field 14 and into an auxiliary field 16. For purposes of a simplified explanation, it is further assumed for the example of both imaging devices 54, 56 that the main field 14 is comprised of seven imaging channels that densely set printing dots, whereby the third imaging channel has failed, and as a result can be replaced by the functional tenth imaging channel positioned in the auxiliary field 14 with a feed of 7p. Here, the writing can occur with a time-controlled feed from the left side to the right side of FIG. 4 with the auxiliary fields 16 and the main fields 14. The imaging spots of these laser diodes in the auxiliary field 14 of the first and the second imaging devices 54, 56 are then positioned on helix-shaped paths 62 on the printing form 32. If a certain azimuth angle and a certain extent along the cylinder axis 52 of the printing form is viewed, the printing dots on the helix-shaped paths 62 are set at a first time, while neighboring helix-shaped paths 64, 66 of the imaging spots of laser diodes from the main field at this azimuth angle and at this certain extent along the cylinder axis are set at a second time. In the exemplary situation described, this is possible after a rotation of the cylinder at a feed of the width of 7p, when the first imaging device 54 has achieved a shifted position 55, and the second imaging device 56 has achieved a shifted position 57. This fact has also been explained respectively in FIG. 3 for rows (printing dots at an azimuth angle).

A control unit 70 is assigned to the first imaging device 54 and the second imaging device 56, by which control unit they are also connected in the shifting in translation direction 58. The control unit 70 is comprised of a processor unit 72, in which a program is executed with at least one section for the performance of the inventive method described above, including its further embodiments. The control unit 70 interacts with the machine control 74. Not illustrated in detail in FIG. 4 is the actuator, the drives for the rotation of the printing form cylinder 50, as well as the translation of the imaging devices 54, 56. These actuators are controlled and/or regulated by the machine control 74. The printing form cylinder 50 can be received in a printing unit 68 of a printing machine 76.

Finally, a numerical example for the performance of the method according to the invention should be included: if an imaging device containing 33 laser diodes that is assigned to one imaging channel each at equal equidistant distances, for example 37 times the minimum printing dot distance p, the imaging can occur at a feed of 33*p, if all laser diodes are capable of being activated. If, for instance, the imaging channels No. 10, No. 20, and No. 30 have failed, only 9 imaging channels could be used for the exposure according to the simple failure strategy. The total imaging time would be extended by more than three times the rate. With the action according to the invention, an exposure is still possible using 19 imaging channels in parallel. The total imaging time is not even doubled. With the method according to the invention, the imaging channel No. 29 writes its data 37 imaging steps (rotations with receiving of the printing form on a rotating cylinder) earlier than the imaging channel No. 9 in the common interleave process if the laser diodes are capable of being activated in all imaging channels.

It is possible with the method according to the invention to expose at an optimally rapid feed. This means that the failure of some of the laser diodes, or imaging channels, respectively, does not necessarily lead to a substantial extension of the total imaging time. At the same time, it is not necessary to have a multitude of replacement laser diodes at hand, which are not used as long as all imaging channels function properly.

It is even possible in the action according to the invention to achieve a multiple redundancy. The method for imaging a printing form according to the invention is characterized by a high variable ability to adjust to different failure configurations on the laser diode bar. By using the auxiliary field of the laser diode bar as replacement imaging channels that expose at an offset of one or more feeds, better use of the laser diode bar is achieved than is the case with the simple failure strategy. The action according to the invention efficiently enables the determination of as high a number as possible of still usable imaging channels that are capable of being activated. The action is advantageous both for an individual imaging device, and a number b of imaging devices.

LIST OF REFERENCE SYMBOLS

10 laser diode bar
12 laser diodes
14 main field
16 auxiliary field
18 failed third laser diode
20 functional tenth laser diode
22 failed eleventh laser diode
24 first part of the auxiliary field
26 second part of the auxiliary field
28 failed eighth laser diode
30 functional first laser diode
32 printing form
34 setting line
36 direction vertical to the setting line
38 printing dot
40 first row of m printing dots
42 second row of m printing dots
44 imaging channel
46 printing dot in the first row
48 printing dot in the second row
50 printing form cylinder
52 cylinder axis
54 first imaging device
55 shifted position of the first imaging device
56 second imaging device
57 shifted position of the second imaging device
58 translation direction
60 helix-shaped paths of the imaging spots
62 helix-shaped path of the imaging spots of a laser diode from the auxiliary field
64 helix-shaped path of the imaging spots of a laser diode from the main field
66 helix-shaped path of the imaging spots of a different laser diode from the main field
68 printing unit of a printing machine
70 control unit
72 processor unit
74 machine control
76 printing machine
a distance of neighboring imaging spots
m*p feed between two imaging steps

What is claimed is:

1. A method for imaging a printing form with an imaging device having a laser diode bar, the laser diode bar having a number n of individually controllable laser diodes each assigned to one imaging channel, imaging spots of the imaging channels being positioned on the printing form in a row, and being shifted relative to the printing form at least with one shifting component parallel to a setting line, the method comprising the steps of:

dividing the number n of laser diodes into a main field with a number m of laser diodes and into an auxiliary field with a number q of laser diodes, n being greater than m and q being equal to n minus m;

imaging the printing form with a number (m−r) of the laser diodes from the main field at a time $t_m$, the imaging spots of the number (m−r) laser diodes being positioned on the setting line of the printing form, and r $\epsilon$(1, . . . q); and imaging the printing form with a number r of the laser diodes from the auxiliary field at least at a different time $t_a$ different from the time $t_m$, the imaging spots being positioned on the same setting line in such a way that the printing dots created by the main field at the time $t_m$, and the printing dots created by the auxiliary field are positioned in a row of m printing dots at even distances a.

2. The method according to claim 1 wherein the m laser diodes of the main field are contiguous.

3. The method according to claim 1 wherein a distance of neighboring imaging spots a is k times a minimum printing dot distance p and k and the number m of the laser diodes in the main field are relatively prime.

4. The method according to claim 3 wherein k is a prime number.

5. The method according to claim 1 wherein imaging spots are set only at a different time $t_a$ by the auxiliary field for the creation of an even row of printing dots in interaction with imaging by the main field at the time $t_m$, and that the imaging channels are shifted between the time $t_m$ and the other time $t_a$, regardless whether $t_m$ is earlier than $t_a$, or vice versa.

6. The method as recited in claim 1 wherein the imaging occurs by the auxiliary field at a number j at different times $t_{ai}$, whereby i=1, . . . j, the printing dots created by the main field and the printing dots created by the auxiliary field being positioned in the row of the m printing dots at the even distances a, and imaging channels being shifted between each imaging step.

7. The method as recited in claim 1 wherein the imaging steps are iterated, a number of the rows of m printing dots being created at the even distances a, whereby a time $t_m$ of the imaging of a first row of the m printing dots by the main field coincides at least with a time $t_a$ of the imaging of a second row of the m printing dots by the auxiliary field.

8. The method as recited in claim 1 wherein a feed in a direction of the setting line between two imaging steps for the row of m printing dots is either a multiple of m times the minimum printing dot distance p, or m times the minimum printing distance p.

9. The method as recited in claim 1 wherein the printing form is received by a rotating printing form cylinder having a cylinder axis and the setting line is oriented parallel to the cylinder axis, and that shifting of the imaging channels occurs relative to the printing form, with an additional shifting component in the circumferential direction of the cylinder perpendicular to the setting line by rotating the printing form cylinder, a feed parallel to the setting line equal to m times the minimum printing dot distance p in the direction of the setting line being achieved when the printing form cylinder has performed a complete rotation.

10. The method as recited in claim 8 wherein the printing form cylinder is in a printing unit of a printing machine.

11. The method as recited in claim 1 wherein the number m is determined by the following steps:

determining all of the failed imaging channels of the laser diode bar;

dividing the laser diodes of the laser diode bar into a potential main field with a number of m' laser diodes, whereby m' is the largest natural number that is prime at least with respect to the minimum distance of neighboring imaging spots a and that is smaller than n, as well as into a potential auxiliary field with a number q', whereby n>m, and q'=(n−m');

checking for a failed imaging channel at the i position of the potential main field whether a functional imaging channel exists in the potential auxiliary field at the position i±r*m', where r is a natural number;

iterating the checking for all failed imaging channels;

iterating the dividing and checking at a reduced number m' until functional imaging channels in the potential auxiliary field correspond to all failed imaging channels in the potential main field;

choosing the largest m' at which functional imaging channels in the potential auxiliary field correspond to all failed imaging channels in the potential main field as the number m.

12. A method for imaging a printing form with a number b of imaging devices, each image device including a laser diode bar having a number n of individually controllable laser diodes, each laser diode being assigned to one imaging channel, and imaging spots of the imaging channels of the number b of laser diodes bars each being positioned in a row on the printing form, the method comprising the steps of:

determining a number m<n according to claim 11 in such a way that functional imaging channels in the auxiliary fields correspond to failed imaging channels in the main fields for each of the number b of laser diode bars;

dividing the number n of laser diodes of each of the number b of laser diode bars into the main field with the number m of laser diodes and into the auxiliary field with a number q of laser diodes, with q=(n−m); and imaging the printing form with the number b of main fields and the number b of auxiliary fields and shifting the imaging channels relative to the printing form.

13. An imaging device for a printing form comprising:

at least one laser diode bar having a number n of individually controllable laser diodes each assigned to one imaging channel; and a control unit having a processor for executing program executable steps including dividing the number n of laser diodes into a main field with a number m of laser diodes and into an auxiliary field with a number q of laser diodes, n being greater than m and q being equal to n minus m;

imaging the printing form with a number (m−r) of the laser diodes from the main field at a time $t_m$, the imaging spots of the number (m−r) laser diodes being positioned on the setting line of the printing form, and r ϵ(1, . . . q); and imaging the printing form with a number r of the laser diodes from the auxiliary field at least at a different time $t_a$ different from the time $t_m$, the imaging spots being positioned on the same setting line in such a way that the printing dots created by the main field at the time $t_m$, and the printing dots created by the auxiliary field are positioned in a row of m printing dots at even distances a.

14. A printing unit comprising at least one imaging device for a printing form according to claim 13.

15. A printing machine comprising at least one printing unit according to claim 13.

* * * * *